United States Patent [19]

Moore

[11] 4,068,429

[45] Jan. 17, 1978

[54] WALL AND WALL PART

[76] Inventor: Alvin Edward Moore, 8712 Manini Way, Diamondhead, Rte. 1, Bay St. Louis, Miss. 39520

[21] Appl. No.: 772,218

[22] Filed: Feb. 25, 1977

Related U.S. Application Data

[63] Continuation-in-part of Ser. No. 569,922, April 21, 1975, and Ser. No. 599,681, July 28, 1975, said Ser. No. 569,922, is a continuation-in-part of Ser. No. 359,800, May 14, 1973, Pat. No. 3,878,661, which is a continuation of Ser. No. 102,317, Dec. 29, 1970, abandoned, said Ser. No. 599,681, is a continuation-in-part of Ser. No. 543,661, Jan. 24, 1975, Pat. No. 3,979,870.

[51] Int. Cl.[2] ..... E04C 1/06

[52] U.S. Cl. ..... 52/204; 52/293; 52/309.12; 52/309.17; 52/354; 52/576; 52/601; 52/615; 428/116

[58] Field of Search ..... 52/576, 577, 496, 497, 52/615, 293, 354, 596, 204

[56] References Cited

U.S. PATENT DOCUMENTS

| | | | |
|---|---|---|---|
| 1,465,653 | 8/1923 | Olander | 52/577 X |
| 1,477,520 | 12/1923 | Pittman | 52/DIG. 9 |
| 1,708,462 | 4/1929 | Bodman | 52/577 X |
| 2,043,445 | 6/1936 | Oxhandler | 52/354 |
| 2,129,441 | 9/1938 | Otto | 52/90 |
| 2,477,852 | 8/1949 | Bacon | 428/116 |
| 2,633,439 | 3/1953 | Konstandt | 428/116 |
| 2,893,076 | 7/1959 | Herts | 52/615 X |
| 2,946,158 | 7/1960 | Seipt | 52/596 |
| 3,228,932 | 7/1967 | Cheskin | 52/577 X |
| 3,721,059 | 3/1973 | Reynolds | 52/577 X |
| 3,858,376 | 1/1975 | Moore | 52/DIG. 9 |
| 3,878,661 | 4/1975 | Moore | 52/DIG. 9 |

FOREIGN PATENT DOCUMENTS

| | | | |
|---|---|---|---|
| 231,277 | 3/1959 | Australia | 52/615 |
| 254,474 | 5/1967 | Austria | 52/577 |
| 1,105,738 | 7/1955 | France | 52/DIG. 9 |

*Primary Examiner*—Alfred C. Perham
*Attorney, Agent, or Firm*—Alvin Edward Moore

[57] ABSTRACT

An upright-wall, ceiling or roof made of panels fastened together along contacting panel edges. Each panel is made of a can-supporting planar element (a sheet of plywood, masonite, plastic or the like), reinforcing bars defining outer edges of the panel, cans between the reinforcing bars, wide-mesh wire or plastic panel-reinforcing network on the cans, and molded matrix material (foamed, cellular, polyolefin plastic, or concrete of portland or other cement and sand or porous aggregate — for example, cinders, vermiculite, pumice, charred sawdust or the like) on the cans. The can-supporting element is placed in a mold, cans are put on this element optionally parallel to it but with their axes preferably perpendicular to it, the wide-mesh network is placed on the cans, and the moldable plastic material in fluent form is poured or injected into the mold thru the wide mesh of the network around the cans and on the network. Each panel preferably includes attachment flanges that are integral with the reinforcing network and fastened to the panel-reinforcing bars. The wall preferably includes a wall plate (preferably of wooden material — for example a sawed lumber plank or bar of masonite) fastened to tops of the panels, and includes wall-finishing material of bricks, concrete blocks, elongated bars or stucco, fixed to surfaces of the panels by mortar or the like.

16 Claims, 23 Drawing Figures

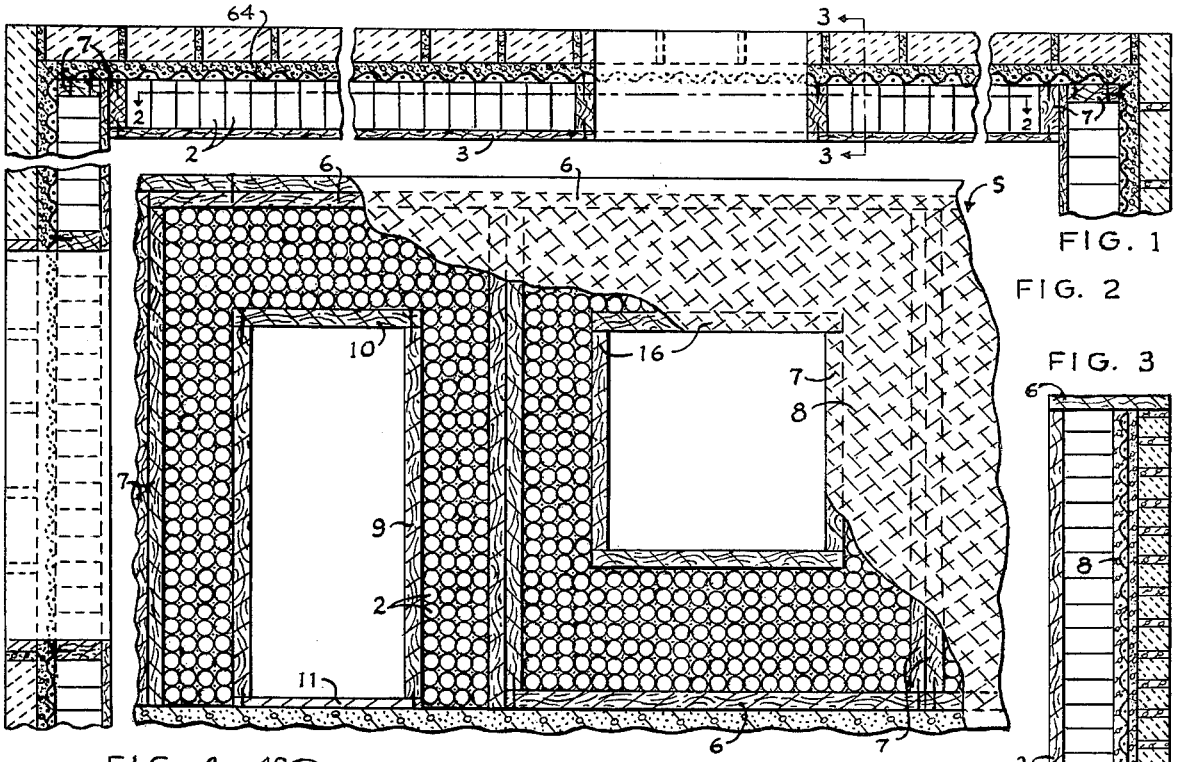
FIG. 1
FIG. 2
FIG. 3
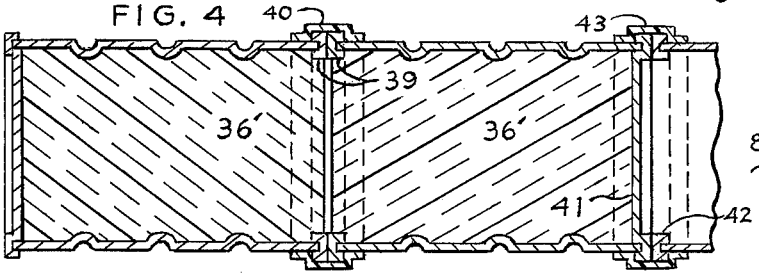
FIG. 4
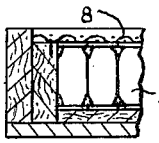
FIG. 5
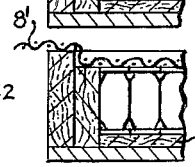
FIG. 6
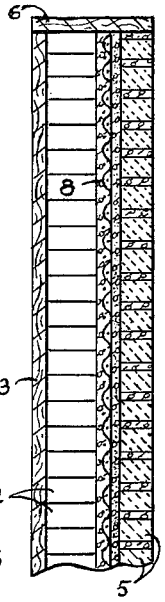
FIG. 7
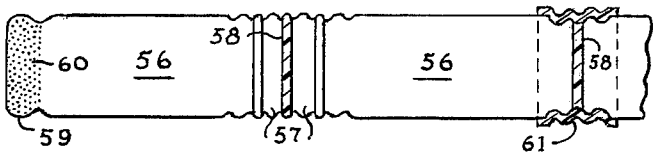
FIG. 8
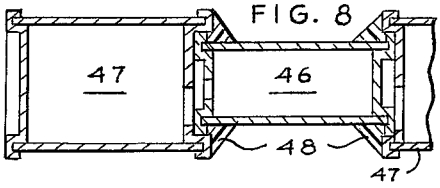
FIG 10
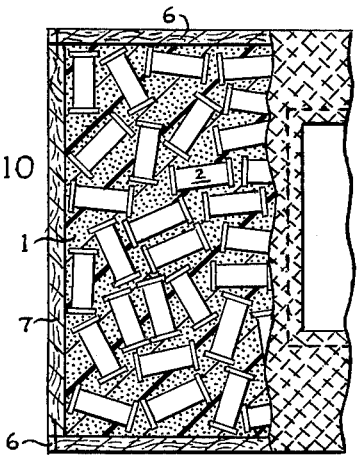
FIG. 11
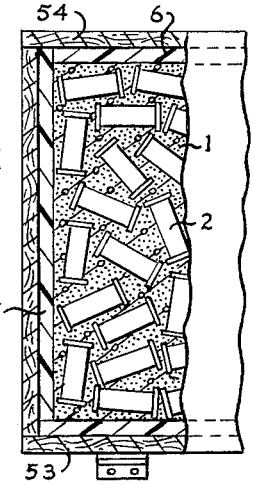
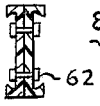
FIG. 9
FIG. 12
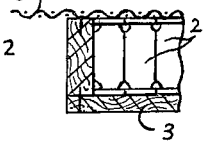
FIG. 13
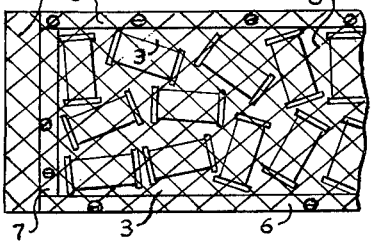

WALL AND WALL PART

This application is a continuation in part of Application Ser. No. 569,922, filed on Apr. 21, 1975, which was a continuation in part of application Ser. No. 359,800, filed on May 14, 1973 (now U.S. Pat. No. 3,878,661), the latter application being a continuation of application Ser. No. 102,317, filed on Dec. 29, 1970, now abandoned. The present application is also a continuation in part of application Ser. No. 599,681, filed on July 28, 1975, which was a continuation in part of application Ser. No. 543,661, filed on Jan. 24, 1975 (U.S. Pat. No. 3,979,870).

In this present application (comprising matter divided from the prior applications in response to requirements for division): FIGS. 15 to 17, 20, 22 and 23 are copies of FIGS. 2 to 4, 7, 9 and 10, respectively of application Ser. No. 569,922; FIGS. 14 and 19 and 21 are similar to FIGS. 1 and 6 and 8 of application, Ser. No. 569,922, with improvements; FIGS. 7, 8, 9 and 11 are copies of FIGS. 6, 7, 6A and 9, respectively, of application, Ser. No. 599,681; and FIGS. 10 and 13 are somewhat similar to FIGS. 8 and 10 of application Ser. No. 599,681.

There has long been a need in construction of houses, mobile homes, trailers, boats and other vehicles of an insulated construction panel (or bar) light enough in weight to be handled easily in building operations, yet strong enough for a strength-providing wall, and easily establishing exterior and interior lines of the house or other construction. Another long-existent need is a solution of the waste and disposal problem of used cans.

In view of these facts, some objects of the present invention are: (1) to provide a wall and wall part comprising a construction element of insulating or insulation-containing cans, preferably of the used type, between strength-providing side bars of studs, sheathed by reinforcing mesh and a matrix of shape-holding material; (2) provision of such a wall and construction element in which the cans are on and have their axes normal to a planar sheet of panel-reinforcing material; (3) provision of such a panel in which the cans have their axes substantially parallel to the can-supporting sheet; (4) a panel as in (3) above in which the cans are of different diameters and those of smaller diameters have end elements fitting within recesses of the larger cans; and (5) a wall comprising a plurality of panels of the above type and exterior wall-finishing material which includes masonry units or troweled or sprayed stucco. These and other objects of the invention are indicated in the following specification and the attached drawings.

In these drawings:

FIG. 1 is a top plan view of a wall, partly broken away and in section along a horizontal plane thru window and door frames;

FIG. 2 is a fragmentary elevational view, shown before application of the exterior masonry or stucco, partly in section from the plane 2—2 of FIG. 1;

FIG. 3 is a fragmental sectional view from the plane 3—3 of FIG. 1, but showing the wall as optionally not having the top wall plate of FIG. 2

FIG. 4 is a fragmentary sectional view of a row of cans of the coffee-containing type, end-joined by adhesive tape;

FIG. 5 is a fragmentary sectional view of a panel including cans in a mold and on a can-supporting planar element with their axes normal to the planar element;

FIG. 6 is a fragmentary sectional view of panel-forming cans and reinforcing mesh in a mold, the cans having their axes normal to a can-supporting planar element, and the mesh having an edge portion overlapping a side wall of the mold to form an attachment flange of the panel;

FIG. 7 is a fragmentary sectional view of end-joined jars or bottles;

FIG. 8 is a fragmentary sectional view of a set or row of end-joined cans of different diameters;

FIG. 9 is a sectional view illustrating an optional method of fastening together removable end caps of cans; FIG. 10 is a fragmentary view in horizontal section showing a plurality of cans dumped into a mold and foamed plastic forming a matrix around the cans;

FIG. 11 is a fragmentary view in horizontal section showing heterogeneously arranged cans surrounded by calcareous matrix material;

FIG. 12 is a fragmentary view in vertical section that is similar to FIG. 6, but shows the attachment flange of network as being substantially in the same plane as the part of the mesh that is fastened to the side bars;

FIG. 13 is a fragmentary plan view of a mold containing heterogeneously arranged cans and a piece of wide-mesh, reinforcing network placed over the cans and fastened to side bars of the panel;

Figure 15:
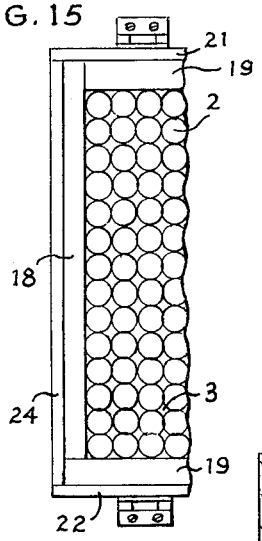
FIG. 15 is a fragmentary plan view of a set of parallel-axes cans on a planar can-supporting element and within a mold, showing filler bars between the cans and mold sides.
Figure 16:
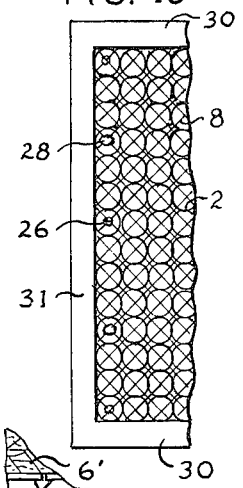
Figure 17:
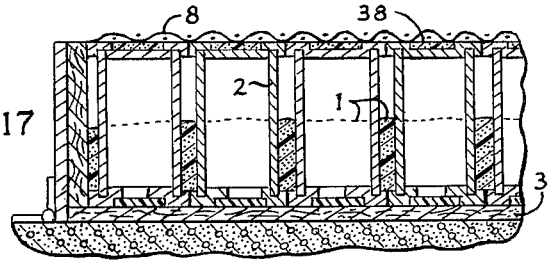
Figure 18:
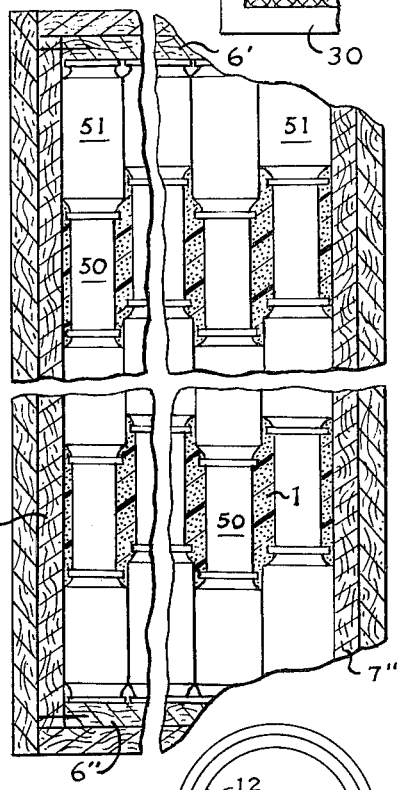
Figure 19:
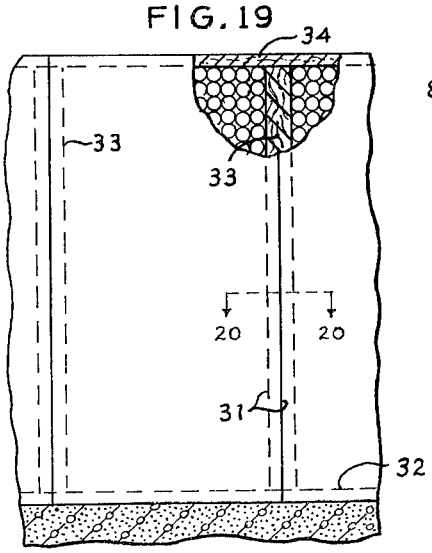
Figure 20:
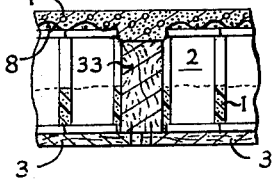
Figure 21:
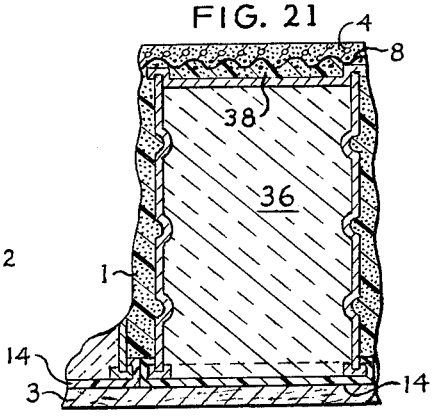
Figure 22:
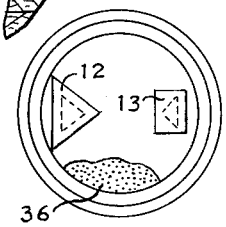
Figure 23:
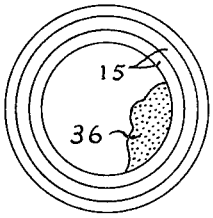

FIG. 16, partly broken away, is a plan view of an optional type of the panel, comprising attachment flanges of the planar can-supporting element, made in the type of mold shown in FIG. 15;

FIG. 17 is a view in section from a vertical plane thru one type of the invented construction member, in which the matrix does not extend above the cans in the mold;

FIG. 18 is a fragmentary view in horizontal section, showing a completed panel comprising rows of end-joined cans in a mold;

FIG. 19 may be considered as a fragmentary, elevational view of panels of the invention joined in an upright wall or a plan view of the panels in a ceiling or floor, part of the figure being broken away to illustrate cans adjacent to a scantling or stud, to which the panels are attached;

FIG. 20 is a sectional detail view on an enlarged scale from the plane 20—20 of FIG. 19;

FIG. 21 is a fragmentary view in section across a construction member utilizing cans of the currently common coffee-containing type, preferably containing insulation;

FIG. 22 is a plan view, partly broken away in section, of another common type of used can, optionally utilized in the invention, shown as optionally containing insulation and having sealed-over openings; and FIG. 23 is a plan view of another type of new or used can, the figure being partly broken away to illustrate can-contained insulation.

The present invention is of a can-comprising wall (an upright wall, ceiling or roof), usable in a building anchored to land, a mobile home or other trailer, a land vehicle, boat, or the like and includes the panel that forms a part of the wall.

In each of the illustrated construction member: the molded, can-holding matrix material may be foamed polyolefin plastic (for example, polyurethane), or cement (for example, calcareous cement (portland cement or mortar cement of portland cement and lime), formica cement, epoxy, asphalt or other organic cement) mixed with fine aggregate (for example, cinders, sand, bits of expanded baked clay or shale ("Haydite"), vermiculite, pumice, shredded or ground polyolefin plastic, charred sawdust or ground bark); the cans 2 preferably are of thin metal, but optionally may be of dense strong plastic or of glass (jars or bottles); and the optional, preferable can-supporting planar element 3 may be a sheet of plywood, masonite, plastic, gypsum board, metal, or the like.

The wall, comprising joined panels may have outer wall-finishing material that is: stucco 4 as illustrated in FIGS. 19, 21 and 21; bricks (or other masonry units, for example, cinder-concrete blocks, hollow tiles, or elongated bars comprising cans of the type set forth in my copending application Ser. No. 714,613, filed on Aug. 16, 1976); or, when the invention is utilized in a roof, asphalt, asbestos or ceramic shingles or tiles.

The invented wall part or panel as illustrated in FIGS. 1 to 3, 5, 6, 12, 14 to 17 and 19 to 21, comprises cans with parallel axes that are normal to the planar can-supporting element 3. But as illustrated in FIGS. 7, 8, 10, 11, 13 and 18 the cans optionally may have their axes parallel to the can-supporting element and the bottom of the mold.

The mold in which the panel is made may be one, with a hinged side or sides, that is separable from the completed panel, as illustrated in FIGS. 5, 6, 11, 14, 15, 17 and 18. Or the mold may become a permanent part of the panel, as illustrated in FIGS. 10 and 13 and optionally in FIG. 12. Then the mold, as well as the panel, comprises four panel-edge bars (preferably sawed-lumber or masonite scantlings or plastic bars). The bars 6 are at the top and bottom of the panel in an upright wall or slanted roof, and the side bars 7 are studs. The panels may be fastened together by toe-nailing contiguous bars of each adjacent pair of the panels — or by bridging across from one upper bar 6 to another bar 6 by nailing or screwing metal strips (for example, short lengths of pipe strap) on the bars — and/or by glueing together contacting faces of the bars 7. Preferably the cans are covered by a reinforcing wide-mesh network 8, which may be wire mesh or of strong plastic. And when the optional network flange 8' is present at a side edge or edges of the panel it is fastened, with or without the above-mentioned nails and pipe strap, by lapping each flange over the stud of an adjacent panel and nailing or screwing the flange in place.

When the panel is formed without a separable mold: the substantially planar can-supporting element 3 is nailed to the four side bars 6 and 7; the cans are placed between the side bars and on the element 3; the wide-mesh wire or strong-plastic network 8 (having mesh sufficiently large for passage of the matrix material in its fluent state thru it — for example, inexpensive poultry-fence network) is nailed to upper edges of the side bars; and fluent matrix material is poured or injected thru the mesh, into spaces between the cans, and onto the planar element 3.

When the panel comprises a door frame 9, or has a relatively thick layer of matrix material over the reinforcing network as indicated in FIGS. 5 and 6, a separable mold, having a hinged side or sides, is preferably used. For example, the door-frame-containing panel as shown in FIG. 2 may be made in a mold of the type shown in FIGS. 5, 6, 14 or 17 by a method which basically comprises the following steps:

1. The can-supporting element 3 is nailed or glued to the side bars 6 and 7 and to edges of the door frame 9. This frame comprises two upright bars, a top bar 10, and a bottom bar 11 which is a carpet sill, all of these bars having a width approximately equal to the length of the cans. Inside the door frame there is a doorway gap, due to cutouts of the element 3 and network 8. The frame and element 3 are placed in the mold with the element 3 beneath the side bars and the frame, and at the bottom of the mold.

Figure 14:
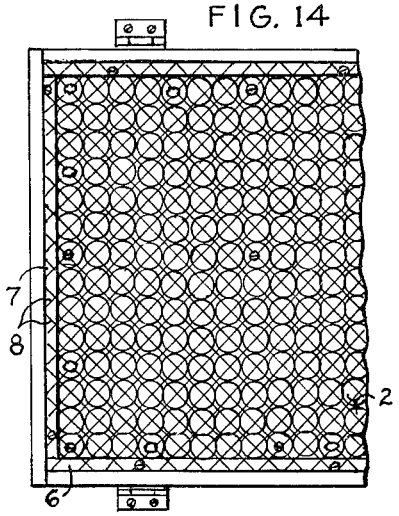
FIG. 14 is a plan view, partly broken away, showing a plurality of network-reinforced, parallel-axes cans within side bars, in a mold.

2. On top of the element 3, outside of the door frame and between the side bars 6 and 7 cans are placed with their axes parallel and upright. These cans may be either new or of the used type having openings in ends of the cans. If new they may be sealed and may contain gas (air or helium), optionally mixed with insulating material of the above-described type. If they are used cans they also optionally may contain thermal insulation, in which event holes in their ends may be sealed over (by pieces of adhesive tape 12 or 13, plastic can caps of the type shown at 14, or lids (15) of cans of the paint-containing type. If used cans of the kind that has contained liquid or coffee or nuts are utilized, each having a hole or holes in one of its end caps, and no easily pourable insulation is in the cans, their hole-containing ends may be turned downward to prevent the moldable matrix material from entering the cans thru the holes where they have been opened. Inside the mold, as illustrated in FIGS. 14 and 15, the cans are positioned in orthogonally arranged rows; but, alternatively, they may be staggered. An optional part of this method step is: coating the planar can-supporting element 3 with asphalt, formica cement, or other adhesive material; and placing the lower can caps on this material before it sets. Or insulating aluminum foil may be tacked or glued on the canward side of the element 3.

3. Reinforcing, large-mesh, wire or strong-plastic network 8 (for example, of the poultry-fence-wire type) is fastened by screws and/or epoxy to upper edges of the bars 5 and 6 and to one or more centrally-located upper can-end covers.

4. The moldable matrix material 1 - a mixture of foam-plastic liquids or of cement and sand or porous, insulating aggregate (for example, portland or mortar cement, Formica, or epoxy, and porous light-weight aggregate, such as expanded shale or clay, pumice or small globules of foam plastic), in its fluent condition, is poured or injected thru the relatively large mesh of the reinforcing network. This material, which flows thru the spaces between the can sidewalls, and preferably settles to a height less than or approximately equal to the length of the cans, serves several purposes: it securely fastens the cans to each other and holds them on the can-supporting planar element; it braces the cans and strengthens the construction member without making it too heavy for easy handling; due to its preferably porosity it provides substanial thermal insulation; and the portion of it which lodges in recesses in upper can-end caps strengthens these ends, and provides insulating, stucco-holding porosity at these ends.

5. (An optional method step): An elongated, trowel-like, thin-edged bar, having a length at least equal to the width of the mold, is operated manually by two workmen or by a machine to sweep over the top of the cans, substantially leveling the molding material resting in the recesses of the upper can-end caps to the plane of the top parts of the cans, smoothly leveling the upper surface of the matrix material.

6. The fluent matrix materials are allowed to set into firm, panel-strengthening material.

7. Taking the completed panel from the mold. If an optional mold cover is used (optionally when the matrix material is a mixture of foaming polyolefin liquids, optionally powered-screw-operated, to clamp the cover against excessive expansion upward of the foaming materials), this seventh step comprises lifting or hinging the mold cover off the top of the panel.

A solid panel which contains no door or window frame (for example, the one indicated at S in FIG. 2) as well as a panel having a window frame 16, optionally may be made by the above method; but preferably each of these types of panels is constructed without a separable mold. And optionally a panel having a door frame 9 also may thus be made; but in this instance a strip of thin metal (for example, of galvanized-iron roof-valley material), having a width substantially equal to the length of the cans is nailed or otherwise fastened to the bottom of the carpet sill 11 and at its ends to bottom edges of the upright side elements of the door frame. Also optionally such a metal strip may replace the lower element 6 of a windowed or solid panel — or the upper element 6, but such is not currently preferred.

A variation of the invention includes placing the studs (33 in FIGS. 19 and 20) separately from the can-and-matrix part of the panel in a modification of the above method which inludes the following steps, with reference to FIGS. 15, 16, 19 and 20:

1. Placing within the four walls of the mold four filler bars (18, 19) which may be wooden boards (of sawed lumber or masonite), hollow metal or hollow or solid plastic, having a height equal to that of the side walls of the mold. When these filler bars are of wooden material, for ease of separation from the matrix material 1 after it has set from previously fluent condition, at least the can-juxtaposed inside surface and the top edge of each of these filler pieces is preferably sheathed by Teflon. This may be applied in liquid form, but preferably it comprises thin sheets of Teflon, glued to the wood or other material of the filler pieces 18 and 19 by a known type of cement which adheres to Teflon. Preferably, the bars 19 are epoxy-glued to the hinged mold walls 21 and 22; and optionally the two opposite bars 18 may be thus cemented to the mold walls 24; and in this event: the top Teflon strips or coatings which sheathe the top edges of 18 and 19 also extend over the upper edges of the four walls 21, 22 and 24 and the mold sides 24, like 21 and 22 are hinged to the mold bottom. These filler bars cover and protect margins of the can-supporting sheet 3 from entry on the margins of matrix material; these margins are to be attachment flanges of the completed wall part.

Method step 2: Placing cans on the element 3, between the filler bars.

3: Placing the optional wide-mesh network 8 on the cans and fastening it to tops of the cans by the screws 26 or solder or epoxy putty 28.

4: Pouring or injecting moldable matrix material of the above-described type thru the wide mesh of the network into spaces between the cans and on the can-supporting element 3.

5: Opening the mold, removing the filler bars 18 and 19 from the attachment flanges 30 and 31 and taking the completed panel part from the mold.

As shown in FIG. 16, the widths of the flanges 30 and 31 are enlarged from the flanges of practice; and the network 8 is illustrated as not being thoroughly covered with the matrix material. This matrix material 1 is shown in FIG. 17 as rising only to about half the height of the cans; but preferably and as illustrated in FIG. 21, it builds up to at least the level of the upper end caps of the cans. When it rises that high, or higher than the network 8, and it is mixed foaming polyolefin liquids (for example, of polyurethane), the mold has a hinged or liftable cover which is clamped tightly on the upper edges of the mold's side walls during setting of the expanding foamed plastic. But when the matrix material is mortar or the like the cover optionally may be eliminated.

Method step 6: Providing on foundation material at the building site a framework that comprises: a lower wall bar 32 (a board of wooden material — sawed lumber or masonite — or else of strong plastic capable of holding nails or glue); studs 33 of wooden material or plastic, nailed or glued to 32; and a wall plate 34, nailed or glued to the studs 33. Each pair of the studs have a space between them that is equal to the width of the can-and-matrix part of the panel that is to be fastened to them.

Method step 7: Placing each of the molded can-and-matrix panel parts between a pair of the studs 33, and nailing or glueing the flanges 30 and 31 to the studs, wall plate 34 and horizontal lower bar 32. Each of the flanges 31 has a width that is in the neighborhood of half of the width of the studs 33 (this flange may be equal to, slightly wider than, or slightly narrower than one-half of the stud width). Each of the flanges 30 has a width that is in the neighborhood of the width of the wall plate 34 — or that of the lower bar 32; that is, each flange 30 may be equal to, slightly wider than, or slightly narrower than the width ofthe upper or lower bar to which it is nailed or otherwise fastened. (Optionally, the lower bar 32 and the flanges for fitting on it may be eliminated; and the can-and-matrix panel part then rests directly on the wall foundation.)

FIGS. 4, 7 to 9 and 18 illustrate optional formation of the cans in rows before or during their placement in the mold. Although they may be assembled in rows in the mold without previous fastening means between the end-joined pairs (in which case the matrix material later bonds the cans together), they are shown in these figures as having such fastening means forming them into rows before these are placed in the mold. FIG. 4 illustrates opened, corrugated cans of the coffee-containing or nut-containing type. The can-end elements of each adjacent pair are abutted together and may be held in this position by bonding material (for example solder, epoxy putty or other glue); but as shown they are fastened together by strips of adhesive tape, tautly wrapped around the abutted end elements. The first two opened can-end elements 39 are shown as held together by the band of adhesive tape 40; the second joint comprises the closed end cap 41 and the opened can-end element 42 which are fastened together by the adhesive-tape band 43; and each of the other joints to the end of the row (not shown) also comprises a closed can-end cap and an opened can-end element fastened together by tape or the alternative bonding material.

FIG. 8 shows a row of end-joined used cans of the type that have contained beer or soft drinks. These cans have different diameters, and at each joint a small-diameter, 10-ounce can, 46, fits inside a larger-diameter can 47 of the 12-ounce, 14-ounce or 16-ounce kind. Epoxy putty, solder or other bonding material, 48, is placed between the nested can rims, holding the cans together.

FIG. 18 shows a panel before it is taken from a mold which comprises beer or soft-drink cans of a currently new type, in which the can-end rims do not project beyond their sidewall tubes. Ends of the smaller cans 50 are nested within recesses in the end caps of the larger cans 51 and optionally may be held in place by bonding material between their nested rims. But preferably they are assembled in closely juxtaposed rows inside the panel bars 6 and 7 one row at a time; and the matrix material, being somewhat adhesive, holds them in place. As indicated, the distance between the panel bars 6' and 6'' is only slightly longer than the length of the can rows, each having well-nested can ends. And the distance between the panel bars 7' and 7'' is approximately equal to the distance spanned by the larger cans 51 of the group of rows when the adjacent pairs of these cans are in contact across the space between 7' and 7''. The slight clearance between the bars 6' and 6'' and the end cans of each row enables fairly tight assembly of the can-end joints; and these hold their position until they are sheathed in the set matrix material 1.

FIGS. 10, 11 and 13 show cans that optionally are heteregeneously dumped into the mold, which is shown at 6, 7 as a fixed part of the panel in FIGS. 10 and 13 and in FIG. 11, at 53 and 54, having at least one wall that is hinged as separable from the panel. When, as is preferably, these cans are of the used type their openings are closed by lids 15, or bits of adhesive tape 12 or 13, or plastic end caps 14, such as those used to fit over cans of the type that contain coffee or nuts. Most of these cans fall into the mold with their tubes and axes parallel to its bottom, and the few that may be inclined to the bottom are quickly moved manually or by machine into parallelism with the bottom. As indicated in FIGS. 10, 11 and 13 there is no line over the mold that is not crossed by a plurality of matrix-reinforcing cans. In rare instances, especially in making a relatively narrow, elongated bar, as in FIG. 13, such a line of possible fracture might not be protectively crossed. But if breakage should occur at such a line it would be so rare as to be unimportant in quantity production. Heterogeneity of the positions of the cans, with numerous angles between their axes, is assured by manually or automatically dropping into the mold a number of the cans less than the number that would be necessary if they were closely and compactly arranged as in FIGS. 14 to 21. The correct number to be dropped is determined by experiment for each size of mold, as being the number that permits many angles between the axes of the cans but does not require too much of the matrix material. The panels or bars are completed by sheathing the cans in the matrix material, which preferably is porous and thermally insulating.

The cans 56 of FIG. 7 may be of dense plastic, but preferably they are glass jars or bottles. Each of these containers is preferably filled with insulation of an above-described type and closed at one end by a metal or molded-plastic cap 57. These caps are preferably screwthreaded and sealingly fit on the screwthreaded open ends of the cans. The caps may be fastened together by solder, welding or a layer 58 of epoxy putty, silicone-rubber cement or other bonding material.

The other end of each of the jars or bottles preferably has an annular bulge, 59; and this bulge preferably is gnarled, by forming tiny protuberances 60 on it during the process of its molding. Some jars and bottles now commonly sold have such gnarled bulges; and these may be used; or, alternatively, specially made glass or plastic jars with such bulged and gnarled ends may be utilized. As illustrated in the right-hand part of FIG. 7, each pair of adjacent bulged can ends may be fastened together by bands of adhesive tape 61. These bands, with overlapping ends, are stiffly stretched to fit snugly around radially outer portions of the bulges 59 and tiny protuberances 60. When the jars have no bulges at their closed ends their end walls may be roughened by coarse sandpaper or a grinding wheel; and these walls may be fastened together by a layer 58 of epoxy putty or the like. Also optionally but not preferably, each end wall that is associated with a bulge 59 may be thus roughened and glued or otherwise bonded to a similar, bulged end of an adjacent jar, before wrapping the bulges with the adhesive tape 61.

Alternatively, and with or without optional bonding material 58, each abutting pair of the end caps 57 or plastic caps (14, FIG. 21) may be fastened together by one or more rod-like elements (rivets or bolts and nuts) as shown in FIG. 9 at 62. This type of joint also may be used to connect end-joined cans of the paint-containing type, shown in FIG. 23. Two lids 15 (or one lid 15 and the closed bottom of a can) may be connected together by bolts or rivets.

The cans provide thermal insulation in the panels. Sealed or dead-air spaces of small volume provide good thermal insulation. Therefore, when the cans are small — for example ten-ounce or twelve-ounce beer or soft-drink cans — they preferably are not filled with porous insulation, especially in view of the fact that the dead-air-space insulation of common metal cans is augmented by the insulating value of their bright inside metallic surfaces. The twelve-ounce cans have a height of approximately $4\frac{3}{4}$ inches and a diameter of approximately $2\frac{3}{8}$ inches, thus providing substanial dead-air insulation. Nevertheless, and as indicated in FIG. 22, such cans of the beer or soft-drink type optionally may be filled with porous insulation, (36); and the larger cans preferably are thus filled. This thermal insulation may be of low cost because it is canned; and for easy filling of cans it is preferably granular or in small bits — for example, easily pourable vermiculite, pearlite, charred sawdust, rice or nut hulls, ashes or dust, cotton linters, bits of bark commercially sold as mulch and ground or shredded, other ground bark, cottonseed hulls, peanut hulls, cinders, bits of expanded clay or shale or of rockwool — or if lightness of weight is not very important, sand, or a mixture of powdered dry clay and charred sawdust. When charred sawdust is used it is of course heated in little or no air. The insulation, indicated at 36 in FIGS. 21 to 23, may be poured into the cans before or after their assembly in the molds, and optionally before application of the wire or plastic mesh, via gang tubes or funnels, continuously connected together at the apertured bottom of a metallic or plastic pan.

In addition to the thermal insulation of the cans and their contents, the invented construction member has insulation in: the plywood or otherwise porous can-backing element 3; the optionally porous matrix material 1 (for example, polyurethane or other foamed plastic) and in the layers 38 of this material in the recesses of those can ends to which the reinforcing mesh is attached); and the preferably porous first coat or coats of the finishing stucco 4, or the alternative bricks 5, cinder blocks or other masonry units.

Preferably, the thickness of the studs 7 and 33, wall plate 34 and wall-base boards 6 and 32 is that of standard "2-inch" lumber — that is, approximately 1¾ inches. When the cans (preferably used) are of the ten-ounce or twelve-ounce beer or soft-drink type, approximately 4¾" high, the breadth of the "two-by-four" studs, wall plates and wall-base boards (3¾ inches) is approximately one inch less than the length of the cans; and when the cans are of the fourteen-ounce type (5 9/16 inches long) the breadth of the utilized "two-by-six" studs, wall plates and wall-base boards is approximately 3/16 inch less than the can length. Thus, in either event, there is a space at an edge of each stud to be filled by the finishing stucco 4 or mortar 64 (FIG. 1). In this space a narrow strip of expanded-metal lath or the like optionally may be nailed, before application of the stucco or mortar.

When the exterior stucco 4 is used its first coat preferably includes cinders, fine aggregate of expanded baked clay or shale, vermiculite, or other porous aggregate (thus providing extra thermal insulation), and the second coat includes sand as aggregate. The wall is then finished by at least two coats of "STA-DRI", "BONDEX" or other waterproofing paint.

The construction member without attachment flanges, as indicated in FIGS. 14 and 17, may be assembled in any kind of wall - for example in an inside partition without masonry backing or inside an outer wall part facing or insulatively "veneering" a concrete-block, brick or stud-and-sheathing wall by attachment to other construction members and to floor or roof-supporting elements with epoxy putty or other strong adhesive.

Within the spirit of the invention various changes may be made. For example, the panels may be elongated and narrow (for example, 6 inches × 8 inches in cross section), and may be horizontally laid in an eight-inch wall, with mortar between adjacent horizontal panel faces. and optionally the planar can-supporting elements 3 may be standard 4 feet × 8 feet pieces of plywood or wallboard; and in this event the cans may be more loosely arranged in the mold than they are shown in the drawings.

In the claims, unless otherwise qualified: "can" signifies a hollow container, open or sealed, of metal, dense plastic or glass; "wall" means an upright wall or a roof, ceiling or floor; "rod-like elements" signifies nails, bolts or rivets; and "stucco" means cement (mortar cement, portland, epoxy or other cement) mixed with fine aggregate, for example, sand, cinders, vermiculite or the like.

I claim:

1. A wall, including a foundation, a plurality of can-comprising panels on said foundation, each adjacent pair of the panels having panel edges that are juxtaposed to each other, means holding said edges in assembled relation, and wall-finishing material on one side of said panels; each of a plurality of said panels including:

a substantially planar can-supporting element on the side of said panel opposite from said wall-finishing material;

at least one panel-reinforcing bar, connected to said can-supporting element;

a plurality of cans on said can-supporting element, some of said cans being juxtaposed to said bar;

panel-reinforcing network on said cans;

means holding said network in place on said cans; and a matrix comprising material of the type that sets into firm material from previously fluent condition, sheathing said cans, in contact with said planar element, and juxtaposed to said bar.

2. A wall as set forth in claim 1, in which said panel includes at least one other panel-reinforcing bar, the said bars comprising a pair of studs having said panel edges and a cross bar fixed to upper portions of said studs; and said panel further includes at least one attachment flange projecting from the said matrix and cans and connecting means fastening said flange to one of said bars.

3. A wall as set forth in claim 1, in which said panel includes at least one other panel-reinforcing bar, connected to said can-supporting element, and further includes: at least a pair of attachment flanges projecting from the said matrix and cans; and fastening means connecting each of said flanges to a said bar.

4. A wall as set forth in claim 3, in which: said attachment flanges are integral with said network; and said fastening means comprises rod-like elements.

5. A wall as set forth in claim 3, in which: said attachment flanges are integral with said substantially planar can-supporting element; and said fastening means comprises rod-like elements.

6. A wall as set forth in claim 3, including three of said panel-reinforcing bars, two of which are studs and the third is a substantially horizontal cross bar, fastened to said studs; and each of said panels includes: three of said attachment flanges, projecting from said matrix and cans; means fastening one of said flanges to said cross bar; and means fastening two of said flanges to said studs.

7. A wall as set forth in claim 6, in which said attachment flanges are integral with said panel-reinforcing network.

8. A wall as set forth in claim 1, in which at least one of said panels includes a door frame, defining a doorway, the said door frame comprising: side bars; an upper bar on said side bars, extending over said doorway; and a carpet sill, fixed to said side bars, extending across the bottom of said doorway.

9. A wall as set forth in claim 8, in which: said reinforcement network includes flanges on said door frame; and said panel further includes means fastening said flanges to said door frame.

10. A wall as set forth in claim 1, in which: at least one of said panels is a windowed panel, including a window frame; said network includes attachment flanges on said window frame; and said windowed panel further includes means fastening said flanges to said frame.

11. A wall as set forth in claim 1, including a framework formed separately from the assembly of said cans and matrix and network; the said framework including a wall plate, a stud at one side of each panel, the said stud being the said one panel-reinforcing bar, said means holding said edges in assembled relation comprising said wall plate and means fastening the wall plate to said studs; and the said substantially planar can-supporting element includes attachment flanges and means fastening said flanges to said studs and wall plate.

12. A wall as set forth in claim 1, in which each of said panels is transportable to a building site as a separate unit, and includes three other panel-reinforcing bars; the said bars including: a pair of studs having said panel edges; an upper cross bar, fixed to said studs, defining the upper edge of said panel; and a lower cross bar, fixed to said studs, defining the lower edge of the panel; and the said panel further includes four attachment flanges and means fastening said flanges to said four bars.

13. A wall as set forth in claim 1, in which said wall-finishing material comprises bricks and mortar.

14. A wall as set forth in claim 1, in which said wall-finishing material comprises stucco.

15. A transportable wall part including:

a substantially planar can-supporting element;

a plurality of bars, connected to said can-supporting element, having edges on edge portions of said element;

a plurality of cans on said planar element, between said bars;

panel-reinforcing network on said cans and means holding said network in place on the cans; and a matrix on said cans and in contact with inner surfaces of said bars, the said matrix comprising material of the type that sets into firm material from previously fluent condition.

16. A wall part as set forth in claim 15, including four of the said bars, and further including a flange that is integral with said network fixed to each of said bars; and means fastening each flange to its associated bar.

* * * * *